United States Patent [19]

Huizenga

[11] Patent Number: 4,922,069

[45] Date of Patent: May 1, 1990

[54] ELECTRICAL CONTROL SWITCH MECHANISM

[75] Inventor: Michael K. Huizenga, Manning, S.C.

[73] Assignee: Aircap Industries Corporation, Manning, S.C.

[21] Appl. No.: 241,371

[22] Filed: Sep. 7, 1988

[51] Int. Cl.[5] ..... H01H 9/20

[52] U.S. Cl. ..... 200/334; 200/51 LM; 200/61.58 R; 200/303; 200/332; 200/332.1; 200/293.1; 439/144; 439/149

[58] Field of Search ..... 200/334, 51 LM, 61.58 R, 200/294, 295, 296, 303, 332, 332.1, 339, 573, 293.1; 439/136, 142, 144, 147, 149, 138, 139, 140, 141, 133

[56] References Cited

U.S. PATENT DOCUMENTS

| | | | |
|---|---|---|---|
| 1,929,662 | 10/1933 | Wappat | 200/332.2 |
| 1,989,823 | 2/1935 | Raabe | 439/144 X |
| 2,211,603 | 8/1940 | Lang | 200/332.2 |
| 2,744,176 | 5/1956 | Kaman | 200/293.1 X |
| 3,422,296 | 1/1969 | Frank | 200/332.2 |
| 4,380,693 | 4/1983 | Kuhlmann et al. | 200/332.1 |
| 4,740,168 | 4/1988 | Carney et al. | 439/133 |

FOREIGN PATENT DOCUMENTS

| | | | |
|---|---|---|---|
| 3417726 | 11/1985 | Fed. Rep. of Germany | 200/334 |

*Primary Examiner*—Ernest G. Cusick

*Attorney, Agent, or Firm*—Watson, Cole, Grindle & Watson

[57] ABSTRACT

Electrical control switch mechanisms of the so-called "dead-man" type which may be used to actuate the operation of small electrically powered tools such as mowers, trimmers and the like. These switch mechanisms provide for immediate deactivation of the tool upon release by the operator.

18 Claims, 1 Drawing Sheet

FIG. 1
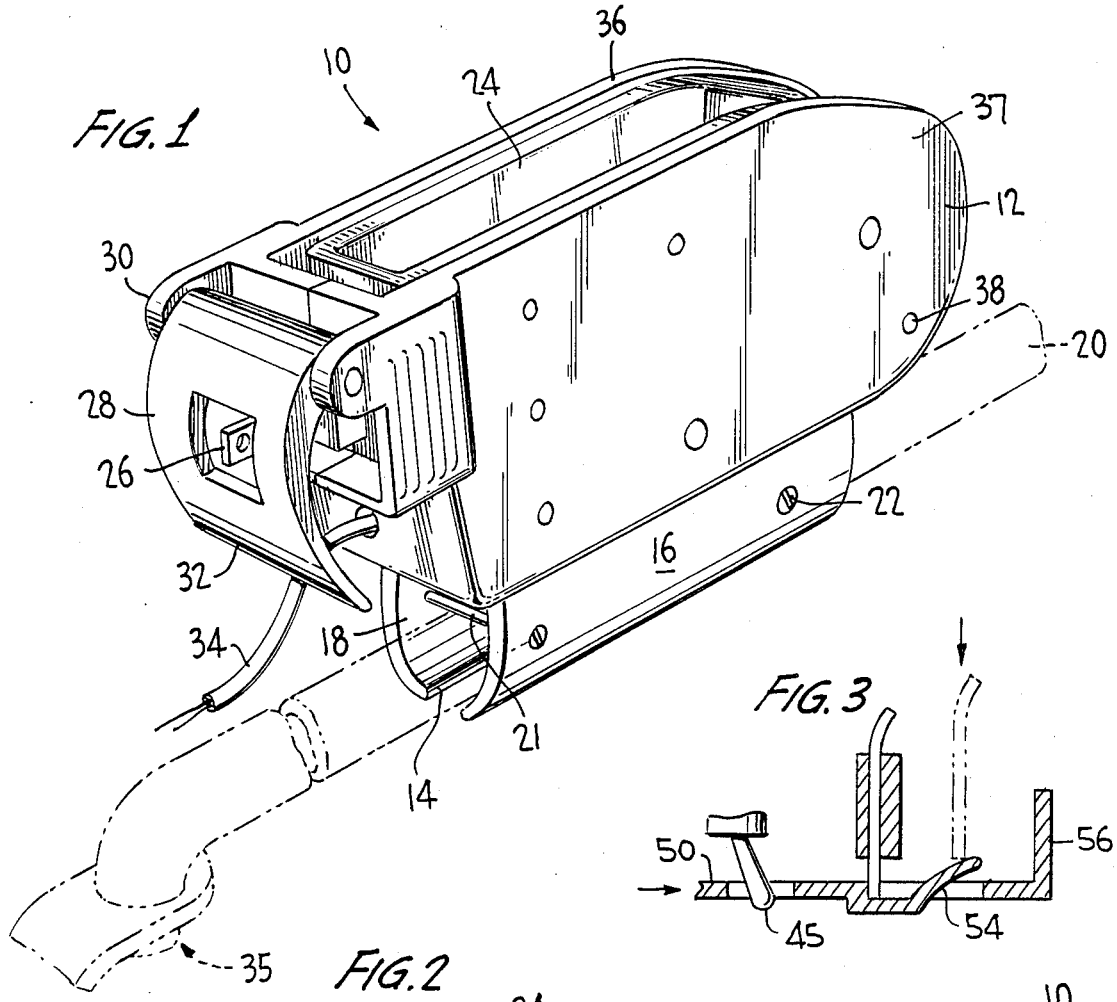
FIG. 3
FIG. 2
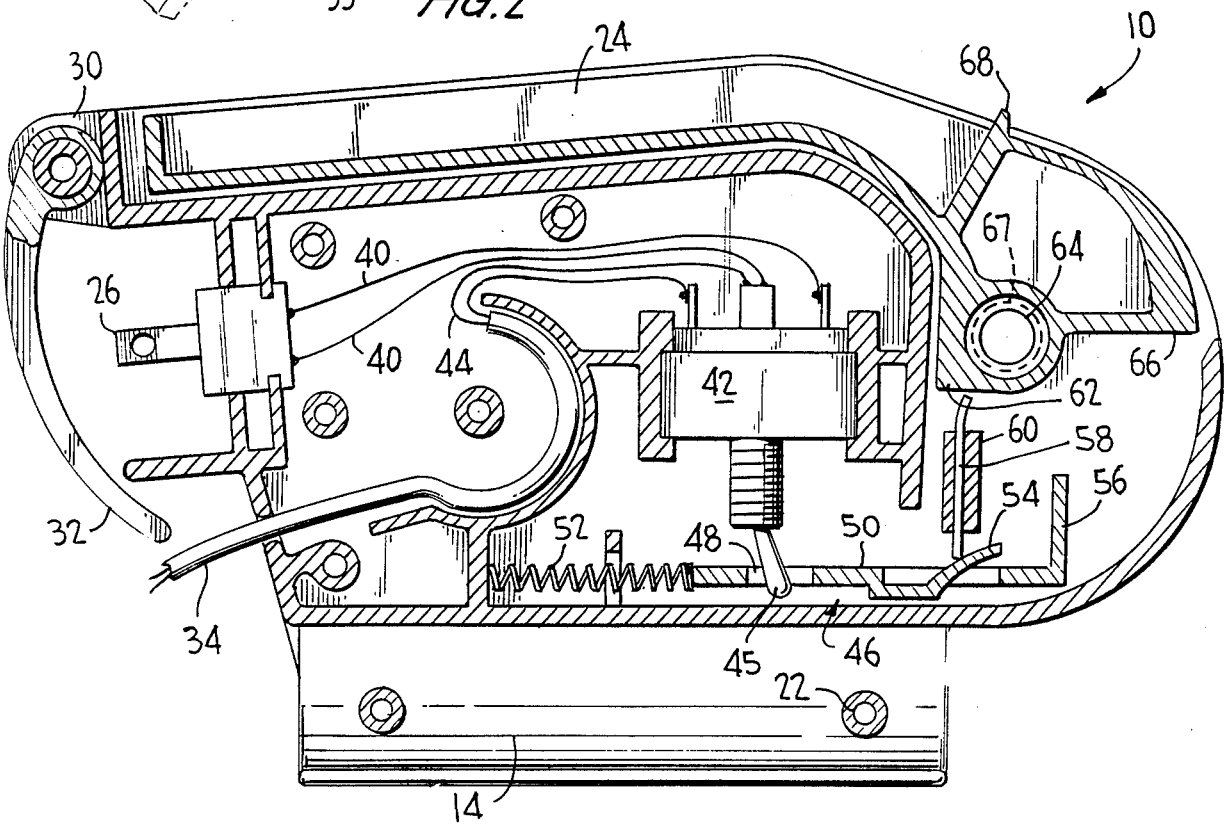

ELECTRICAL CONTROL SWITCH MECHANISM

The present invention relates generally to electrical control switch mechanisms, and, more particularly, to so-called "dead-man" type control switch mechanisms which may be used to actuate the operation of small electrically powered tools such as mowers, trimmers and the like and provide for immediate deactivation of the tool upon release by the operator.

BACKGROUND OF THE INVENTION

For a number of years, the U.S. Product Safety Commission has required that certain new electrically powered tools such as lawn mowers, trimmers and the like be equipped with an actuator which will automatically stop the operation of the tool when the operator releases the actuator, e.g., a "dead-man" type actuator. Such actuators help prevent accidental injury to the operator as it makes it difficult for the operator to approach the moving parts of the tool while the tool is still actuated, as well as terminating operation of the tool if the operator loses control of the tool by slipping or the like. Furthermore, the Commission has required that the actuator for the tool be of a construction which requires the operator to perform two separate or distinct functions in order to activate the tool in order to minimize inadvertent or accidental operation. Such an actuation also makes it more difficult for children to operate the tool.

There are numerous designs for such actuators presently being incorporated into new electrically powered tools. While most operate satisfactorily for their intended purpose, many suffer from the disadvantages that they are difficult for the operator to actuate, they are physically taxing to maintain in the actuated position and are relatively complicated in construction and thus are difficult and expensive to manufacture.

SUMMARY OF THE INVENTION

It is therefore a feature of the present invention to provide an electrical control switch mechanism for a power tool which is relatively easy to manipulate by the operator.

Another feature of the invention is to provide an electrical control switch mechanism for a power tool which is of a relatively simple construction and is therefore quite easy to manufacture.

It is a further feature of the invention to provide an electrical control switch mechanism for a power tool which provides essentially immediate action to deactivate the tool when the operator releases his grip on the control.

Yet another feature of the present invention is to provide an electrical control switch mechanism wherein a control handle for activation has a relatively large movement to minimize operator fatigue.

Another feature of the present invention is to provide an electrical control switch mechanism which minimizes switch contact wear by having a "snap-action" movement.

A further feature of the invention is to provide an electrical control switch mechanism which includes a cord plug retaining device.

Briefly, in its broader aspects, the present invention comprehends a switch mechanism adapted for use in controlling the operation of an electrically powered tool, the mechanism comprising a housing containing a toggle-type electrical switch, means for introducing an electrical current to said switch, electrical output means from said switch to the tool adapted to be controlled by said mechanism, and switch actuating means within the housing for moving the toggle of said electrical switch between open and closed positions, said switch actuating means comprising an elongated biased handle pivotably mounted within said housing, a slider mounted within the housing adapted for sliding movement and having an aperture receiving the toggle of the switch, sliding movement of said slider causing said switch to change between the open and closed positions, said slider being biased in one direction of said sliding movement by biasing means; said handle being positioned within said housing such that an engaging surface of said handle, upon rotation of the handle against its bias, causes sliding movement in a direction opposite provided by the slider biasing means so as to change the position of said switch, said actuating means further including an elongated member within guide means having one end against a ramp on said slider, the member being mounted within said housing such that upon return of said handle to its biased position, a boss carried by the handle contacts the opposite end of said member and forces the member against the ramp of the slider to assist in its movement caused by the biasing means.

Further objects, advantages and features of the present invention will become more fully apparent from a detailed consideration of the arrangement and construction of the constituent parts as set forth in the following description taken together with the accompanying drawing.

BRIEF DESCRIPTION OF THE DRAWINGS

In the drawings,

FIG. 1 is a perspective view of a switch mechanism according to the present invention, the mechanism being shown relative to the handle bar of an electrically powered tool, FIG. 2 is a side view of the switch mechanism of FIG. 1, the view being partly in section to illustrate the interaction among the components of the mechanism and their relationship to the switch housing, and FIG. 3 is a detail view of the operation of the actuating means for the switch mechanism.

DETAILED DESCRIPTION OF THE PREFERRED EMBODIMENTS

Referring first to FIG. 1, shown is switch mechanism 10 according to the invention. Mechanism 10 comprises housing 12 with depending curved side flanges 14 and 16 defining slot 18. Switch mechanism 10 is adapted to be mounted on handle bar 20 of an electrically powered tool by having the handle bar pass through slot 18 and by means of appropriate fasteners 21 extending through mounting holes 22 so as to draw side flanges 14 and 16 toward each other.

Switch mechanism 10 includes actuating handle 24 pivotably mounted within housing 12. Handle 24 is located within the confines of housing 12 such that the mechanism presents a smooth overall appearance. On one end of the exterior of mechanism 10 is male electrical plug 26 adapted to receive the end of an extension cord or the like for transmission of electrical energy to switch mechanism 10. Overlying plug 26 is cord holder or retaining device 28 which is pivotably attached to housing 12 between ears 30 and is spring biased such that two inwardly curved arms 32 forming a part of the holder contact the exterior of housing 12. Holder 28 is adapted to be rotated away from plug 26 and then, after connection of the plug to the end of an extension cord, swung back to its biased position against housing 12. With arms 32 bearing against the enlarged end of the cord helps to prevent its accidental removal from switch mechanism 10. Extending from the same end of housing 12 as plug 26 is power cable 34 which leads to the tool portion 35 to be controlled by switch mechanism 10.

For ease in manufacture and assembly of switch mechanism 10, housing 12 is preferably constructed of two housing halves 36 and 37 which are, in most respects, mirror images of each other. These housing halves 36 and 37 are secured to each other by suitable fasteners such as screws extending through a plurality of holes 38 formed in the sides of the housing halves.

Turning now to FIG. 2, the interior of switch mechanism 10 is shown in greater detail. Electrical conductors 40 from plug 26 lead to toggle switch 42 located in the central portion of housing 12 and conductors 44 from the switch lead to outlet power cable 34. Toggle switch 42 is of conventional construction and thus will not be described in detail. Although switch 42 shown is a toggle type switch, basically almost any type of conventional switch which has an outwardly-extending actuating arm would be suitable for the purposes of the present invention. As used herein, the term "toggle-type switch" encompasses such switches. As is shown, switch 42 is opened and closed by depending toggle arm 45 controlled by actuating means 46 operatively connected to handle 24. In actuating means 46, toggle arm 45 extends into slot 48 of slider 50 forming part of the actuating means. Slider 50 is biased by spring 52 such that, in the position shown in FIG. 2, switch 42 is open. Slider 50 further includes upwardly-extending ramp 54 and vertical end piece 56. Resting atop ramp 54 is elongated member 58 slidably carried within fixed guide 60, the member extending upwardly so that its upper end is in close proximity to boss 62 on handle 24. On the opposite side of pivot axis 64 for handle 24 from boss 62 is projecting surface 66.

By suitable means such as a coil spring 67 about pivot axis 64, handle 24 is biased in the position shown such that it is contained within housing 12. Provided on the upper surface of handle 24 is grasping portion 68 to enable an operator to start rotation of the handle and pull it out of housing 12.

To operate switch mechanism 10 so as to provide electrical power to an attached tool, the operator rotates handle 24 in the above-described manner a sufficient distance that projecting surface 66 on the handle contacts end piece 56 and then causes sufficient movement of slider 50 to force toggle switch 42 to the closed position. As long as the operator maintains handle 24 in this position, electrical energy will be supplied to the tool. Upon release of handle 24, the biasing force about pivot axis 64 will cause the handle to return to its original position within housing 12. At the same time, the combination of spring 52 on the end of slider 50 and the force generated by boss 62 bearing on member 58 and thus on ramp 54, causes the slider to move back to its original position and open switch 42. The forces acting during closing and opening of switch 42 are illustrated in FIG. 3. It should be noted that the provision of both the spring 52 and member 58 help to ensure that switch will be opened when the operator releases handle 24. Thus an extra margin of safety in operation of a tool is provided by the switch mechanism 10.

Furthermore, the relatively long movement of handle 24 in actuation of switch 42 provides for an ease in movement for the operator and a positive change in the position of the switch and thus minimal "tease" characteristics of the switch contacts. The latter feature helps prolong the life of the contacts in switch 42 along with promoting the "snap action" of the switch.

While there has been shown and described what is considered to be a preferred embodiment of the present invention, it will be apparent to those skilled in the art that various changes and modifications may be made therein without departing from the invention as defined in the appended claims.

I claim:

1. A switch mechanism adapted for use in controlling the operation of an electrically powered tool, the mechanism comprising a housing containing a toggle-type electrical switch having an outwardly-extending actuating arm, means for introducing an electrical current to said switch, electrical output means from said switch to the tool adapted to be controlled by said mechanism, and switch actuating means within the housing for moving the actuating arm of said electrical switch between open and closed positions, said switch actuating means comprising an elongated biased handle pivotably mounted within said housing, said handle having an engaging surface and a boss, a slider mounted within the housing adapted for sliding movement and having an aperture receiving the actuating arm of the switch and having a ramp, sliding movement of said slider causing said switch to change between the open and closed positions, said slider being biased in one direction of said sliding movement by biasing means; said handle being positioned within said housing such that the engaging surface of said handle, upon rotation of the handle against its bias, causes sliding movement in a direction opposite provided by the slider biasing means so as to change the position of said switch, said actuating means further including an elongated member within guide means having one end against the ramp on said slider, the member being mounted within said housing such that upon return of said handle to a biased position of the handle, the boss carried by the handle contacts the other end of said member and forces the member against the ramp of the slider to assist in movement of the slider caused by the biasing means.

2. A switch mechanism according to claim 1, wherein the means for introducing electrical current to said switch includes a male-type plug mounted on the housing electrically connected to the switch.

3. A switch mechanism according to claim 2, wherein the housing includes, in close proximity to the male pug, a pivotably mounted retainer adapted to engage and hold an end of an extension type cord.

4. A switch mechanism according to claim 3, wherein said retainer comprises two generally parallel arms biased against the housing.

5. A switch mechanism according to claim 4, wherein the arms of said retainer extend on either side of said plug.

6. A switch mechanism according to claim 1, wherein said slider includes a vertical end piece adapted to engage with the engaging surface of the handle.

7. A switch mechanism according to claim 1, wherein said handle, as biased by its biasing means in the closed position, is contained within said housing.

8. A switch mechanism according to claim 7, wherein said handle includes grasping means to enable an operator of a tool to initiate manual rotation of said handle against is the handle biasing means.

9. A switch mechanism according to claim 1, wherein said housing includes means for mounting said mechanism on a handle bar of a tool, said means comprising two extending mounting members defining a slot and fasteners extending flanges said mounting flanges.

10. An electrically powered tool comprising tool portion attached to a handle bar and a switch mechanism mounted on the handle bar for controlling operation of the tool portion, the switch mechanism comprising a housing containing a toggle-type electrical switch having an outwardly extending actuating arm, means for introducing an electrical current to said switch, electrical output means from said switch to the tool portion, and switch actuating means within the housing for moving the actuating arm for said electrical switch between open and closed positions, said switch actuating means comprising an elongated biased handle pivotably mounted within said housing, said handle having an engaging surface and a boss, a slider mounted within the housing adapted for sliding movement and having an aperture receiving said actuating arm of the switch and having a ramp, sliding movement of said slider causing said switch to change between the open and closed positions, said slider being biased in one direction of said sliding movement by biasing means; said handle being positioned within said housing such that the engaging surface of said handle, upon rotation of the handle against its bias, causes sliding movement in a direction oppsosite provided by the slider biasing means so as to change the position of said switch, said actuating means further including an elongated member having one end within guide means being against the ramp said on said slider, the member being mounted within said housing such that upon return of said handle to a biased position of the handle, the boss carried by the handle contacts the other end of said member and forces the member against the ramp of the slider to assist in movement of the slider by the biasing means.

11. A tool according to claim 10, wherein the means for introducing electrical current to said switch including a male-type plug mounted on the housing electrically connected to the switch.

12. A tool according to claim 11, wherein the housing includes, in close proximity to the male plug, a pivotably mounted retainer adapted to engage and hold an end of an extension type cord.

13. A tool according to claim 12, wherein said retainer comprises two generally parallel arms biased against the housing.

14. A tool according to claim 13, wherein the arms of said retainer extend on either side of said plug.

15. A tool according to claim 10, wherein said slider includes a vertical end piece adapted to engage with the engaging surface of the handle.

16. A tool according to claim 10, wherein said handle, as biased by its biasing means in the closed position, is contained within said housing.

17. A tool according to claim 16, wherein said handle includes grasping means to enable an operator of a tool to initiate manual rotation of said handle against the handle biasing means.

18. A tool according to claim 10, wherein said housing includes means for mounting said mechanism on a handle bar of a tool, said means comprising two extending mounting flanges defining a slot and fasteners extending between said mounting flanges.

* * * * *